United States Patent [19]

Schütz et al.

[11] 4,166,549

[45] Sep. 4, 1979

[54] WIDE-NECKED BARREL AND LID HAVING FASTENING MEANS

[76] Inventors: Udo Schütz, Rückersteg 4, D-5418 Selters, Westerwald; Michael Rudbach, Dorfstrasse, D-5419 Dierdorf-Wienau; Bernd Breuer, Haindorf 36, D-5439 Rothenbach-Obersayn, all of Fed. Rep. of Germany

[21] Appl. No.: 912,076

[22] Filed: Jun. 5, 1978

[30] Foreign Application Priority Data

Oct. 21, 1977 [DE] Fed. Rep. of Germany ..... 2747327

[51] Int. Cl.[2] ..... B65D 45/32

[52] U.S. Cl. ..... 220/319; 220/356

[58] Field of Search ..... 220/306, 308, 319, 356, 220/357; 215/317, 320, 274

[56] References Cited

U.S. PATENT DOCUMENTS 3,848,767 11/1974 Naf ..... 220/308

3,851,788 12/1974 Hammes ..... 220/319

*Primary Examiner*—George T. Hall

*Attorney, Agent, or Firm*—Young & Thompson

[57] ABSTRACT

A wide-necked barrel made of synthetic resin has a removable lid that has a lip-like inner rim axially interfitting into the barrel neck and an edge externally overlapping the barrel neck. The external edge of the lid has spaced extensions that extend obliquely downward and that receive between them projections integrally molded into the barrel neck, so that the upper side of the extensions and the under side of the projections of the barrel neck form a circumferentially extending V-slot that receives a tightening ring. The projections of the barrel neck are trapezoidal as seen in side elevation; and inside the barrel neck, at the location of the spaces between those trapezoidal projections, the material of the barrel neck is compressed into an annular series of supporting beads for the lip-like inner rim of the lid.

4 Claims, 2 Drawing Figures

WIDE-NECKED BARREL AND LID HAVING FASTENING MEANS

Figure 1:
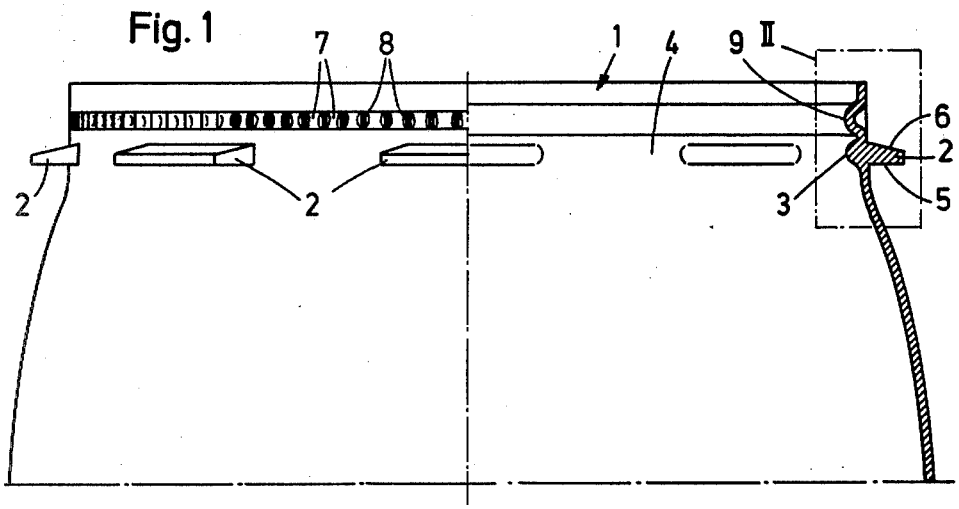

The invention relates to wide-necked barrels made of synthetic resin with removable lids, the lids having a lip-like bead axially interlocking onto the barrel neck and an edge externally overlapping the barrel neck with outward-sloping extensions in a segment-like arrangement, which extensions receive between them projections integrally molded with the barrel neck, the extensions of the lid and the projections of the barrel neck forming a V-slot which extends circumferentially for the reception of a tightening ring.

Such a synthetic resin barrel is disclosed, for example, in German Offenlegungsschrift No. 2,258,096, in which the projections on the barrel neck are formed as curvatures which are hollow toward the interior of the barrel and integrally molded during the blowing of the barrel. This results in a very severe fissuring of the barrel neck, so that said barrel neck is too yielding for radial and axial stress, because the curvatures function like a bellows. The sealing between the lid and the barrel is especially impaired upon radial stress.

The object of the present invention is to increase the mechanical strength of the barrel head by an inherently more rigid design of the barrel neck in connection with the lid.

According to the invention, this object is achieved in that the projections of the barrel neck are formed, in a longitudinal cross section of the barrel, in a trapezoid shape and these projections consist of the solid synthetic resin of the barrel compressed in a plastic state and in that the thermoplastic synthetic resin material of the spaces between the projections of the barrel neck is displaced placed towards the interior of the barrel for the formation of supporting rims for the lip-like inner bead of the lid.

Expediently, the lower surfaces of the trapezoid-shaped projections of the barrel neck extend radially while their upper surfaces form an obtuse angle with the barrel neck.

Further reinforcing of the barrel neck, especially in an axial direction, is attained by an arrangement of alternating recesses and protrusions like a toothed wheel provided above the projections on the barrel neck.

The form of the entire barrel neck according to the invention produces a more favorable stress distribution in the material of the barrel neck which is designed more rigidly in its totality in a radial as well as in an axial direction. The total height of the barrel neck is also decreased by the compression of the material; and with a suitable adjustment of the compression stroke and the chamber volume of the blow mold, the material between the barrel neck projections is displaced more or less deeply toward the interior while still in a plastic state. The resulting series of beads in the interior of the barrel neck forms an additional support for the inner lip of the lid upon radial stress. An inner rim in the barrel neck is also provided in the aforementioned conventional synthetic resin barrel; but this inner rim is located at the height of the lid floor when the lid is on and thus cannot support the inner lip of the lid, which inner lip has the tendency to buckle under radial stress.

Figure 2:
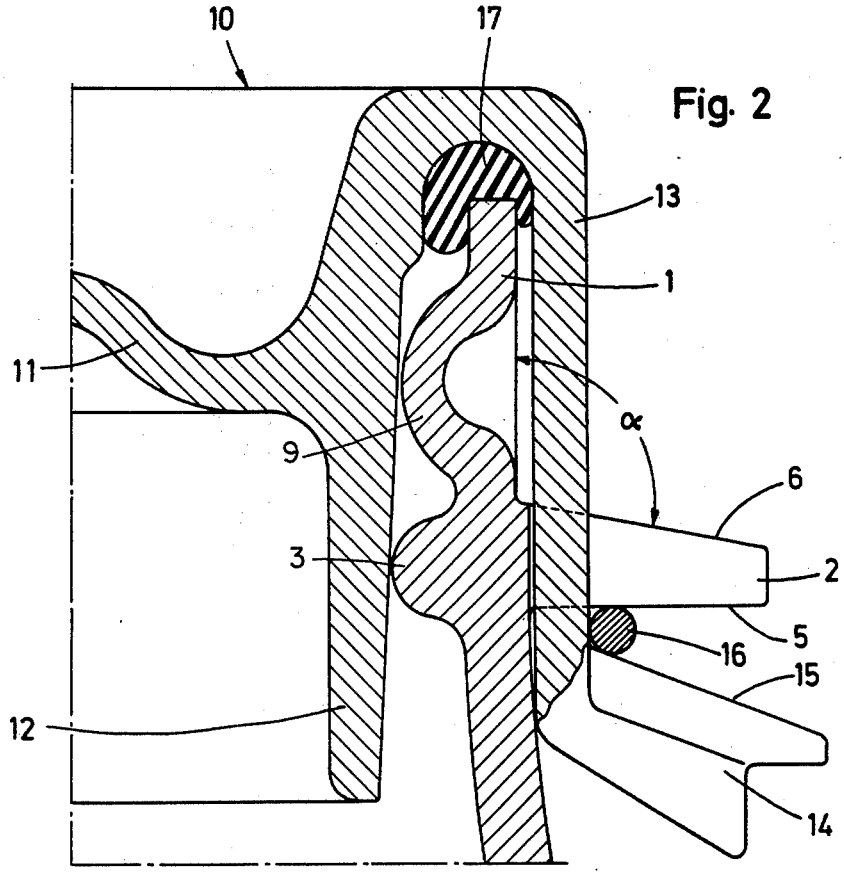

The drawing shows an embodiment of a wide-necked barrel made of synthetic resin, according to the invention, in which:

FIG. 1 is a fragmentary side elevational view of the barrel head, the right half of which is shown in cross section; and FIG. 2 is an enlarged view of the region II of FIG. 1, with the lid on.

The synthetic resin barrel, of which only the upper portion or barrel head is depicted in FIG. 1, is blown, for example, of polyethylene in a conventional manner; and then a portion of the blow mold in the area of the barrel neck 1 is pushed together in an axial direction in such a way that the synthetic resin material is compressed, so that projections 2 jutting outward and supporting beads 3 protruding inwards result (see also FIG. 2). The supporting beads 3 are located opposite the spaces 4 between the projections 2, whose lower surfaces 5 extend radially and whose upper surfaces 6 form an obtuse angle $\alpha$ with the barrel neck 1.

Above the projections 2 and the spaces 4, a number of recesses 7 and protrusions 8 are provided around the circumference of the barrel neck 1, this arrangement being similar to a toothed wheel. In the interior of the barrel neck 1, the recesses 7 form another torus 9, which is located at the height of the bottom 11 of the lid 10 when the lid is on, from which lid a lip-like rim 12 projects into the interior of the barrel in an axial direction of the barrel and which lid supports itself on the reinforcing beads 3 under mechanical stress. The inner edge 13 of the lid 10 externally overlaps the upper edge of the barrel neck 1 and said inner edge has extensions 14 in a segment-like arrangement, which extensions are located in the area of the spaces 4 with an upper, inclined surface 15 somewhat below the height of the lower surfaces 5 of the projections 2 of the barrel neck and which extensions form together with these projections a circumferential V-slot for the mounting of a tightening ring 16. The lid 10 and the barrel neck 1 are releasably clamped together to seal the barrel neck, upon the insertion of an elastic sealing ring 17, by the tightening ring 16, e.g. a wire with a tightener, to comprise a rather rigid unit which radially as well as axially resists even the most severe mechanical stress.

I claim:

1. In a wide-necked barrel made of synthetic resin with a removable lid, which lid has a lip-like inner rim axially interlocking into the barrel neck and an edge externally overlapping the barrel neck with a plurality of extensions oriented obliquely downward in a segment-like arrangement, which extensions receive between them projections integrally molded with the barrel neck, wherein the extensions of the lid and the projections of the barrel neck form a V-slot which extends in a circumferential direction for the reception of a tightening ring; the improvement in which the projections of the barrel neck have, in the longitudinal cross section of the barrel, a trapezoidal shape of solid cross section, the projections consisting of the solid synthetic resin of the barrel compressed in a plastic state, the synthetic resin material of the spaces between and at the same level as the projections of the barrel neck being displaced toward the interior of the barrel and forming a plurality of spaced supporting beads for the lip-like inner rim of the lid.

2. A barrel as claimed in claim 1, in which the lower surfaces of the trapezoid-shaped projections of the barrel neck extend radially and their upper surfaces form an obtuse angle with the barrel neck.

3. A barrel as claimed in claim 1, and a plurality of alternating recesses and protrusions above the projections on the barrel neck.

4. A barrel as claimed in claim 1, and an inwardly extending annular bead on the interior of the barrel neck above said supporting beads.

* * * * *